US005129244A

United States Patent [19]

Wittman

[11] Patent Number: 5,129,244

[45] Date of Patent: Jul. 14, 1992

[54] OPENER FOR SECURITY PACKAGE WITH ROTATABLE LOCKING CHANNEL

[75] Inventor: Boyd C. Wittman, Shorewood, Minn.

[73] Assignee: Empak, Inc., Chanhassen, Minn.

[21] Appl. No.: 667,531

[22] Filed: Mar. 11, 1991

[51] Int. Cl.[5] ..... E05B 65/00

[52] U.S. Cl. ..... 70/57.1; 70/63; 70/401

[58] Field of Search ..... 70/57.1, 58, 63, 401, 70/408, 409; 24/3 F; 101/250-252, 269

[56] References Cited

U.S. PATENT DOCUMENTS

| | | | |
|---|---|---|---|
| 3,125,873 | 3/1964 | Robinson | 70/63 |
| 3,577,917 | 5/1971 | Nantz | 101/252 X |
| 3,650,209 | 3/1972 | Allport | 101/269 |
| 3,828,922 | 8/1974 | Holkestad | 70/63 X |
| 4,047,410 | 9/1977 | Close | 70/401 |
| 4,285,429 | 8/1981 | MacTavish | 70/63 X |
| 4,299,870 | 11/1981 | Humble | 70/57.1 X |
| 4,589,549 | 5/1986 | Hehn | 70/63 X |
| 4,834,238 | 5/1989 | Hehn et al. | 206/387 |
| 4,865,190 | 9/1989 | Gregerson et al. | 206/387 X |
| 4,993,245 | 2/1991 | Ott | 70/57.1 |

*Primary Examiner*—Renee S. Luebke
*Assistant Examiner*—Suzanne L. Dino
*Attorney, Agent, or Firm*—Haugen and Nikolai

[57] ABSTRACT

A device for opening security packages used to protect audio-visual media from being stolen is disclosed. The security package opening device includes a base which assists with proper positioning of the security package to be opened. It also includes a slidable opening mechanism which, when slid forward, automatically causes key elements to enter the locking means of the security package. The slidable opening mechanism then unlocks the security package permitting the contents of the security package to be removed.

3 Claims, 4 Drawing Sheets

OPENER FOR SECURITY PACKAGE WITH ROTATABLE LOCKING CHANNEL

BACKGROUND OF THE INVENTION

1. Field of the Invention

The present invention relates to a device for opening security packages. More specifically, it relates to a device for easily opening security packages used to prevent shoplifting of audio cassettes, video cassettes, compact disks or other small items which could be easily stolen from a store.

2. Background of the Invention

For some time there has been a need to secure small and relatively expensive audio-visual articles in security packages to inhibit shoplifting. U.S. Pat. No. 4,865,190 dated Sep. 12, 1989 shows a reusable security package ideally suited for this purpose. Security packages of the type shown in U.S. Pat. No. 4,865,190 have been very successful in the marketplace. They have proven to be an inexpensive and effective means for preventing shoplifting of audio-visual cassettes and disks.

In the past, store clerks have been supplied with hand held keys to open security packages of the type shown in the '190 patent. These keys do work effectively opening the lock. Such key elements can break, however, if uneven pressure is applied to the key as the lock is opened. Keys also can be clumsy to use. This is particularly the case when the clerk must open several security packages at a time or when there is a rush at the check out counter. Also the keys, themselves, can be lost or stolen because of their size. The present invention overcomes these disadvantages of the keys presently in use by providing a security package opening device which is quick, convenient and easy to use. It is also of a size which allows it to sit conveniently on a check out counter without any substantial risk that it will be lost or stolen.

SUMMARY OF THE INVENTION

The purpose of the invention is to provide a device for opening security packages of the type generally shown in U.S. Pat. No. 4,865,190. In the preferred embodiment, the opening device has a size and shape comparable to devices typically found in stores for stamping receipts with credit cards. The device has a base including a slot in which the locked security package is inserted. The walls and surfaces of the slot index the locked security package in the proper position for opening. The base also has a pair of opposing guide channels which retain and index an opening mechanism which can be slid back and forth in the guide channels. The keying mechanism includes a handle member and means for rotatably securing in proper position a key designed to open the lock of the security package.

When used the end of the security package which retains the cassette or disk is inserted through the slot until it engages the front surface of the slot. The operator then pushes the handle forward. When the key reaches the appropriate position, it automatically rotates into the lock of the security package. The operator can then pull back on the handle to unlock and open the security package. After the security package is opened, the operator removes the cassette or disk "jewel box" from the security package and the security package from the opener.

The principle object of the present invention is to provide a device for quickly and easily opening reusable security packages of the type used in stores to protect audio-visual media from shoplifting.

Another object of the present invention is to provide a device for opening such a security package having a slidable opening mechanism and means for properly indexing the security package in the device.

Still another object of the invention is to provide a device for opening a security package which can accommodate security packages of differing sizes or having differing locking mechanisms.

A further object of the invention is to provide a device for opening a security package which can accommodate different keys.

Another object of the present invention is to provide a security package opening device which is relatively inexpensive and easy to use.

Another object of the invention is to provide a device which will easily open the security package and help protect the opening elements of the key from damage or breakage due to uneven stress or pressure.

These and other objects of the present invention will be readily apparent from a review of the following detailed description of the preferred embodiment in conjunction with the accompanying drawings and claims.

DETAILED DESCRIPTION OF THE PREFERRED EMBODIMENT

Figure 1:
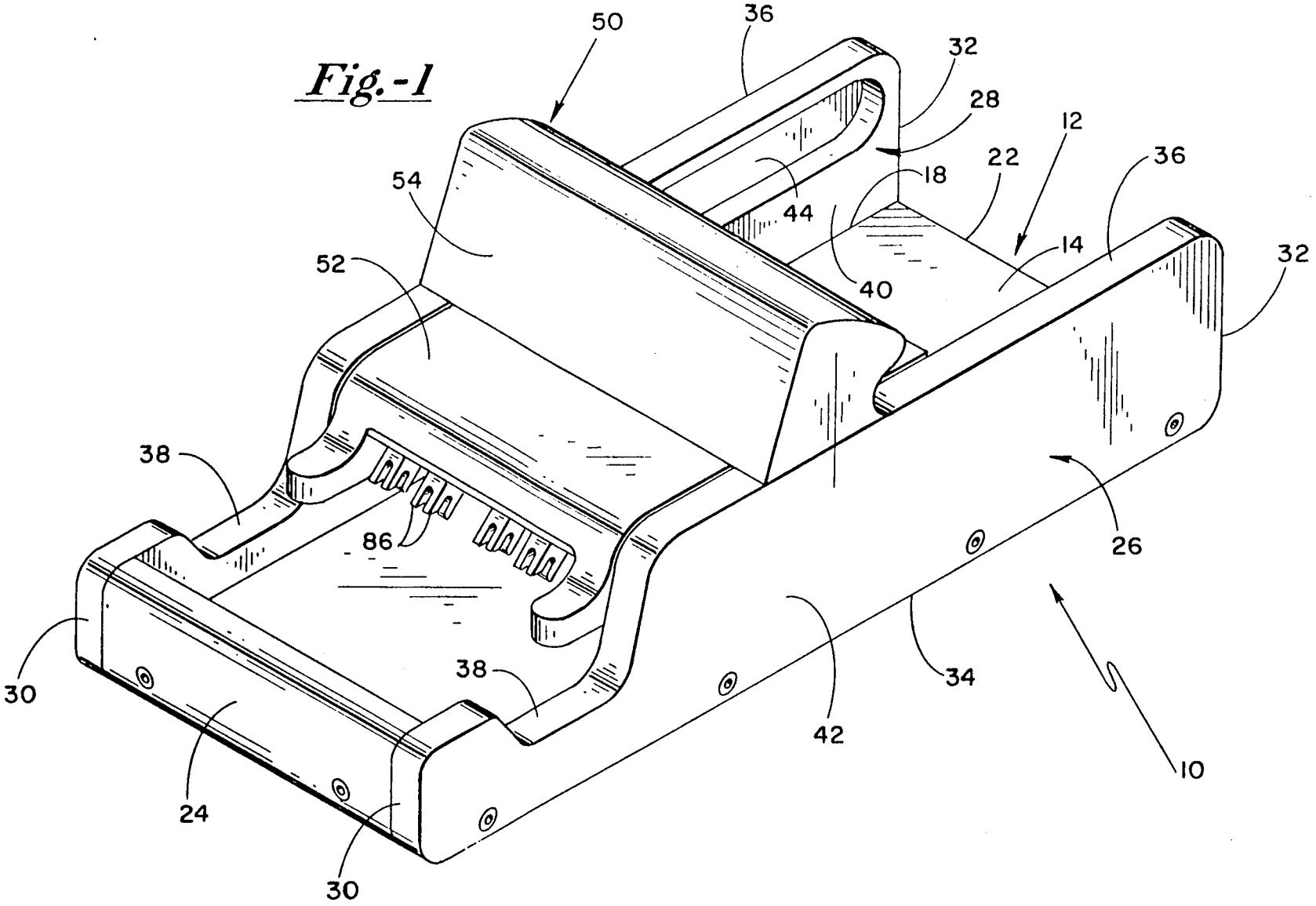
FIG. 1 is a perspective view of the opening device of the present invention.

FIG. 1 shows a perspective view of the security package opening device of the present invention. As shown in the drawing, the opening device is comprised of a main housing 10 and a slidable spinning mechanism 50.

The main housing 10 has base 12. The base 12 has a flat bottom 13, a flat top 14, a pair of opposing side edges 16 and 18, a front edge, and a back edge 22. Secured to the front edge and projecting upwardly therefrom is an end plate 24. The portion **24*a* of the end plate 24 which projects above the top 14 of a base 12 serves as a stop. The main housing 10 also includes a pair of side rails 26 and 28. Side rail 26 is secured to edge 16 of base 12. Side rail 28 is secured in a similar fashion to edge 18 of base 12. Side rails 26 and 28** are parallel and spaced apart.

Each of said rails 26 and 28 has a generally rectangular shape when viewed from the side. Side rails 26 and 28 also each have a front edge 30, and a back edge 32. The height of the front edge 30 is approximately the same height as the end plate 24. The back edge 32 is approximately twice as high as the front edge 30. The bottom edge 34 of side rail 26 is relatively straight. The top edge 36 is relatively straight along the rearmost thereof. The front ¼ of the top edge 36 can be characterized as having an arcuate recess 38. Each side rail 26 and 28 also has an inside surface 40 and an outside surface 42. The inside surface 40 of the side rails have a groove 44 which extends generally parallel to its bottom 34 from a position behind the arcuate recess 38. The grooves 44 in the side rails 26 and 28 are aligned with one another.

In the preferred embodiment, the base is made of aluminum. A durable plastic such as ABS could also be used. Other suitable materials can, of course, be used without deviating from the invention.

The slidable opening mechanism 50 has a slider block 52 and a handle member 54 projecting upwardly from the block 52. The handle member 54 may be integrally molded with the block 52. The block 52 of the slidable opening mechanism 50 is narrower than the distance between slide rails 26 and 28. This permits the block 52 to fit between the slide rails 26 and 28 and be slid either toward or away from the end plate 24 of the main housing 10.

Four rollers 56, 58, 60 and 62 are rotatably attached to the block by axle pins 64, 66, 68 and 70 respectively. Rollers 56 and 58 are attached to one side 72 of block 52. The rollers 56 and 58 are dimensioned to fit and rotate within groove 44 in side rail 26. Rollers 60 and 62 are rotatably attached to the side 74 of block 52. They are dimensioned to fit within the groove 44 of the side rail 28. When assembled with the four rollers fitted within the groove, the upper and lower surfaces of the groove serve to index and retain the slidable opening mechanism at the correct height. The end walls of the grooves 44 serve as stops which prevent the slidable opening mechanism from moving too far forward or too far back. In summary, the walls of the groove, in combination with the rollers, serve to keep the slidable opening mechanism secured to the main housing as the device is operated.

Figure 2:
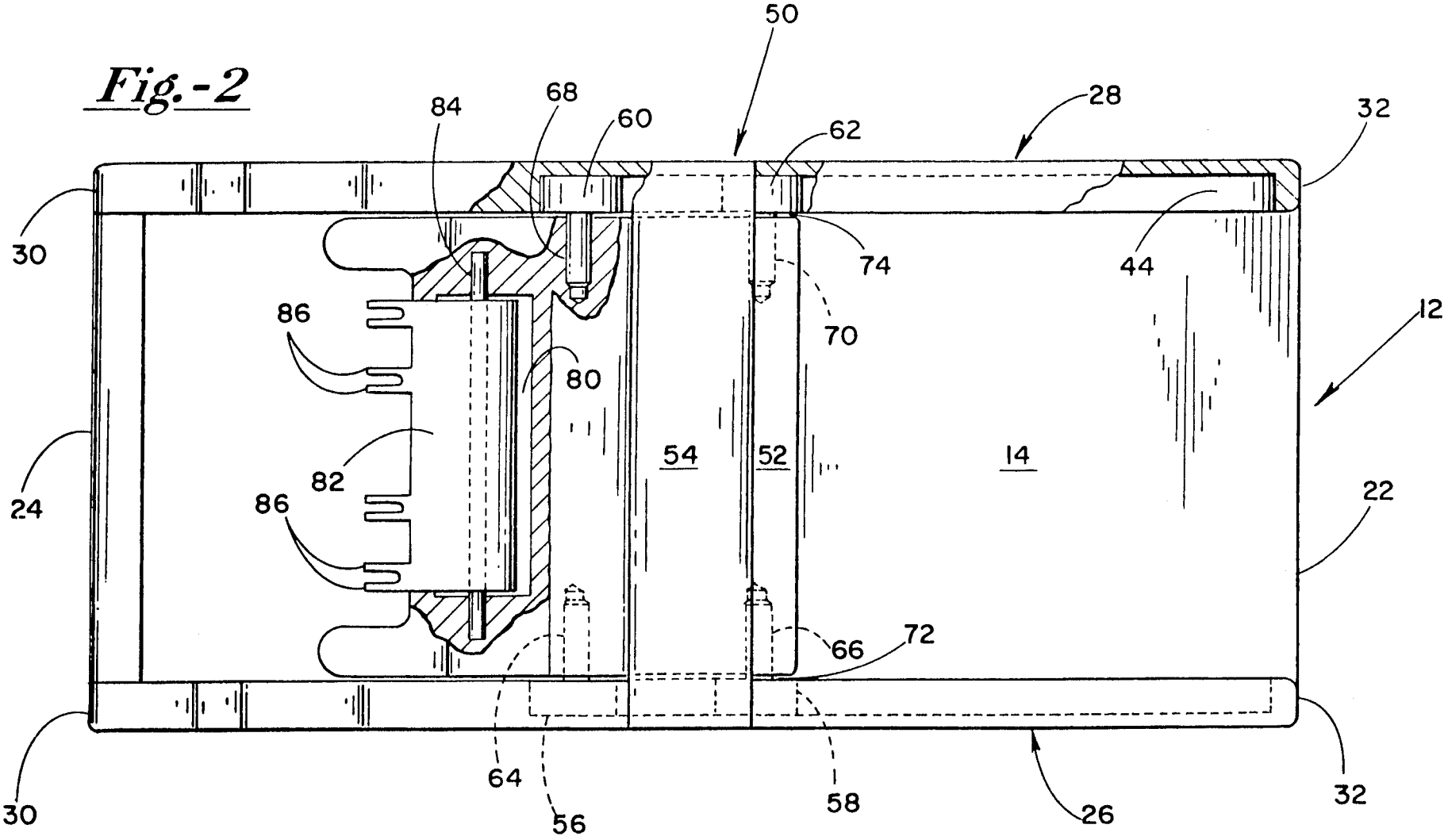
FIG. 2 is a partial sectional plan view of the opening and device.
Figure 3:
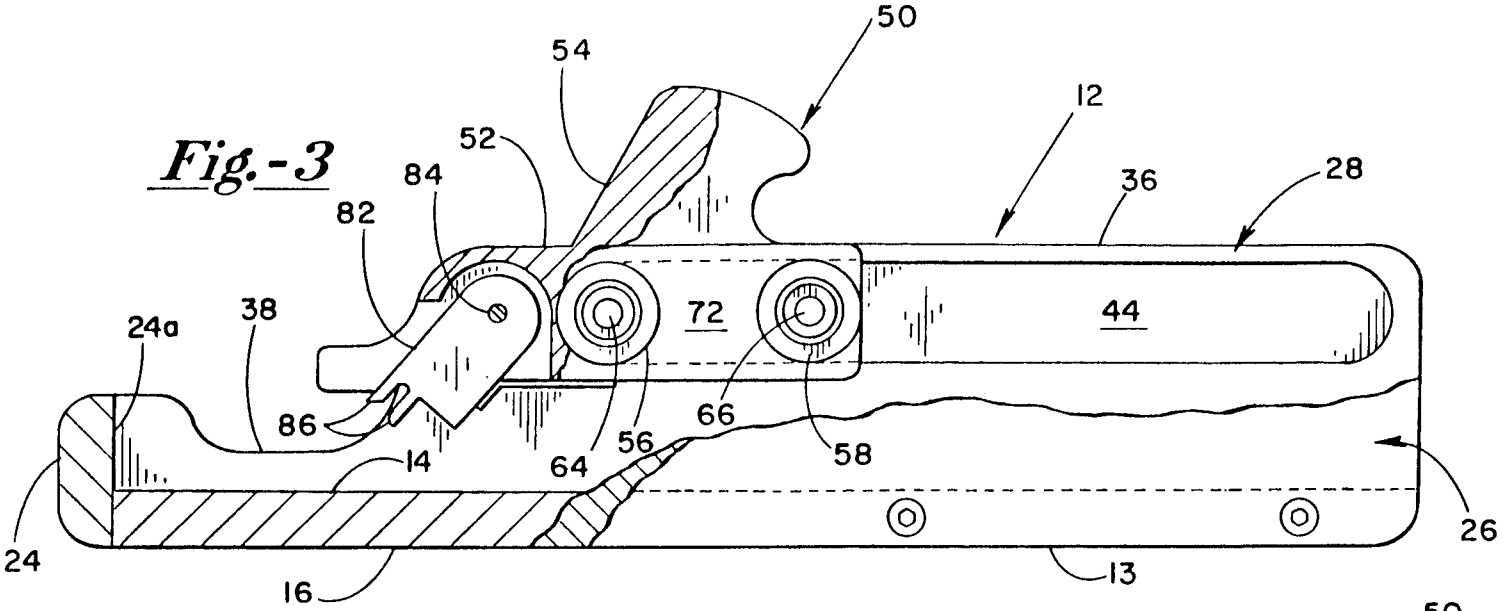
FIG. 3 is a partial sectional side elevation through line 3—3 of FIG. 2.

FIG. 2 shows that the forward section of the block 52 includes a hollowed out area 80 in the bottom of the block. This area is designed to receive an elongated key 82 of the type used to open the devices disclosed in U.S. Pat. No. 4,865,190. Other keys to accommodate different locks on the security package could also be used without deviating from the invention. The hollowed out area 80 is not only large enough to receive the key 82, but also to permit it to rotate between the position shown in FIG. 5 and the position shown in FIG. 6. Keys designed to be used with the device of the present invention will preferably have a cylindrical bore extending through it as shown in the drawings. The key is then held rotatably in place by an axle 84 which passes through the bore. The axle 84 is held in place by the block because opposite ends of the axle 84 are received and rotatably held in place by aligned bores in block 52 located an opposite sides of the hollowed out area 80. When so assembled, the key is free to rotate between the positions shown in FIGS. 5 and 6.

Figure 5:
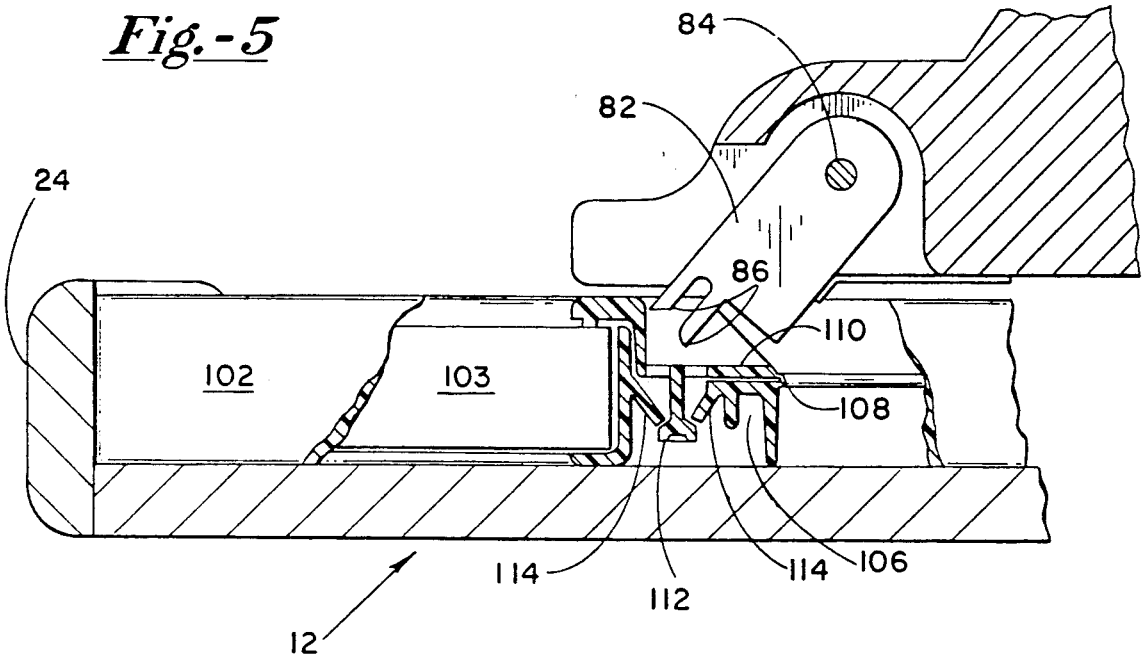
FIG. 5 is a partial sectional view showing a security package to be opened with the key in its disengaged position.
Figure 6:
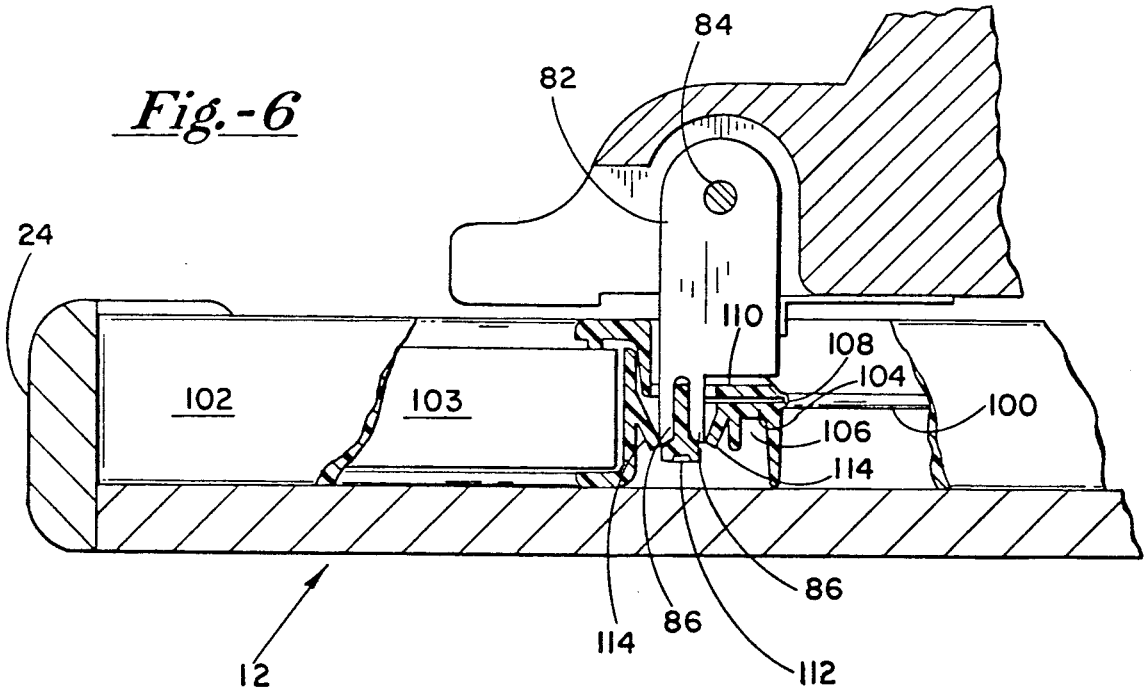
FIG. 6 is a partial sectional view showing a security package to be opened with the key in its engaged position.

To fully understand the operation and advantages of the present invention, it is important to understand the structure of the security package it is designed to open. Such security packages have an elongated handle 100. Integrally molded with the handle is a rectangular structure 102 which receives and retains the item 103 to be held by the security package. The rectangular structure has a planar surface 104 across the top. Planar surface 104 has four catch ports 106, one of which is shown in FIGS. 5 and 6. A living hinge 108 is secured to the end of the planar surface 104. Secured to the opposite side of the living hinge is a planar member 110 which includes latch means 112 aligned with the catch ports 106. The security package is locked by rotation of the planar member 110 about the living hinge 108 and insertion of the latch means 112 in the catch ports 106. The catch ports 106 have opposing angled teeth 114 which engage opposing beveled surfaces on the latch means 112 for mating with an end surface on the angled teeth 114.

The key 82 for opening the package includes elements 86 which enter the catch ports 106 and spread the teeth 114 away from the beveled surfaces on the latches 112 releasing the latches 112 and unlocking the security package. FIG. 6 shows the key 82 in its engaged position with elements 86 in the catch port 106 spreading the teeth 114 away from the beveled surface of the latch means 112.

Figure 4:
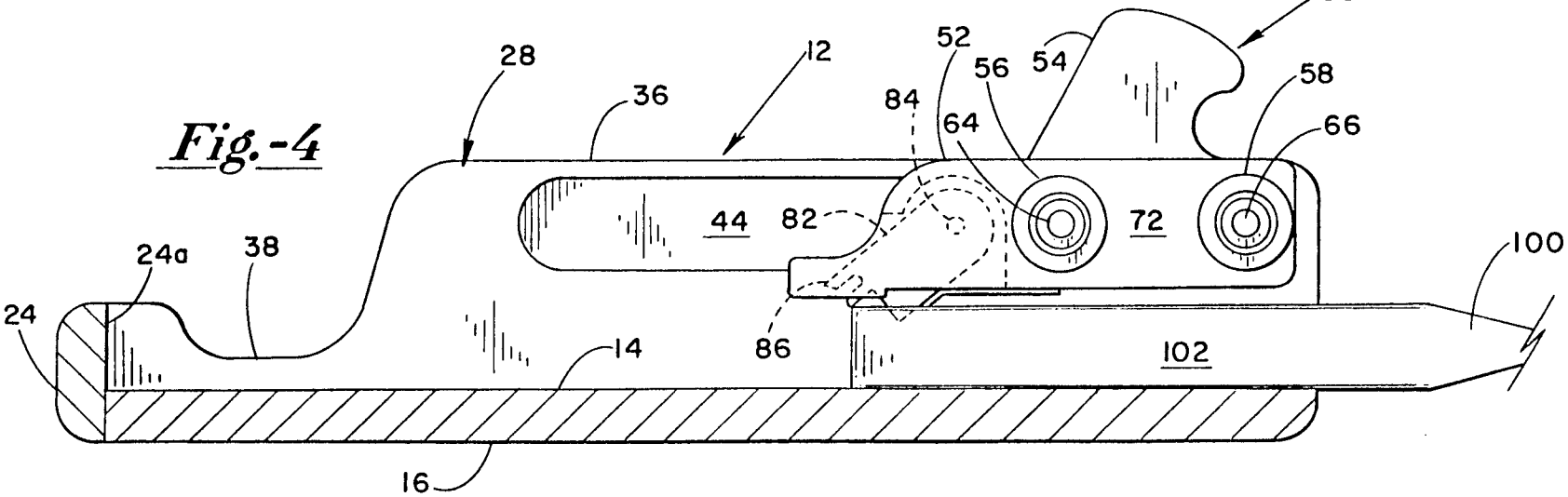
FIG. 4 is a cross-sectional view through line 4—4 of FIG. 2.

Operation of the present invention will now be discussed. With the device 10 sitting on a countertop, stand or table, the operator pushes back on the handle 54 so that the slidable opening mechanism 50 is in the position shown in FIG. 4. As shown in FIG. 4, the locked security package is then inserted into the device from the back between the base 12 and the slidable opening mechanism 50. For the device to work properly, the rectangular structure 102 of the security package must be inserted first with the planar surface 104 facing up. The operator continues to advance the security package into the device until the front of the security package engages the end plate 24.

The operator then pulls forward on the handle 54 causing the slidable opening mechanism 50 to advance along the groove 44. When the front of the key 82 reaches the catch ports 106, the key 82 automatically rotates from the position shown in FIG. 5 to the position shown in FIG. 6 so that the elements 86 enter the catch ports 106. This rotational action occurs when the elements 86 engage upper surfaces associated with the catch ports. The elements 86 then spread the angled teeth 114 releasing the latches 112 from the catch ports 106. The operator then pushes back on the handle 54. This action causes the latches 112 to be pulled out of the catch ports 106 and the planar member 110 upon which the latches 112 are mounted to rotate about the living hinge 108. The security package is, thus, opened.

The tape, video or compact disk box 103 within the rectangular member 102 of the security package can be removed from the front of the device. The arcuate recesses 38 in the side rails 26 and 28 permit the sides of the jewel box 103 containing the disk or tape to be easily grasped. The empty security package can be removed by pulling on its handle 100 from the back of the opening device 10.

Various modifications can be made to the present invention without departing from its scope.

What is claimed is:

1. A device for opening a security package comprising:

(a) a main housing including a base, an end plate projecting upwardly from the front of the base and a first side rail projecting upwardly from one side of the base, a second side rail projecting upwardly from the opposite side of the base, said side rails having opposing, aligned, parallel grooves; and (b) a slidable opening mechanism having a block dimensioned to fit between the side rails, at least one roller attached to each side of said block, said rollers dimensioned to fit within said grooves on said side rails to slidably attach said slidable opening mechanism to main housing, said slidable opening mechanism further including a handle projecting upwardly from said block, and means for rotatably mounting a key to said block, said housing and said slidable opening mechanism forming a channel into which the security package to be opened can be inserted.

2. A device for opening the lock of a security package used to prevent shoplifting, said device including:

(a) A housing have a base, an end plates, an open back and a pair of opposing side rails forming a channel into which the security package may be inserted.

(b) a block;

(c) means for securing said block to said housing so that said block can slide toward and away from said end plate between said side rails above the base, means for pivotably mounting a key to said block so that said key will enter and open the lock of a security package in the channel as the block is slid toward said end plate and will open the security package in the channel as the block is then slid away from the end plate.

3. The apparatus of claim 2 further including means for removing the contents of the security package after it has been opened from the device at a location between the end plate and the block.

* * * * *